US009131762B2

(12) United States Patent
Buffinton

(10) Patent No.: US 9,131,762 B2
(45) Date of Patent: Sep. 15, 2015

(54) BACKPACK HAVING REMOVABLE FRAME

(75) Inventor: Stephen Buffinton, Augsburg (DE)

(73) Assignee: Deuter Sport GmbH, Gersthofen (DE)

( * ) Notice: Subject to any disclaimer, the term of this patent is extended or adjusted under 35 U.S.C. 154(b) by 136 days.

(21) Appl. No.: 13/180,586

(22) Filed: Jul. 12, 2011

(65) Prior Publication Data

US 2012/0012629 A1 Jan. 19, 2012

(30) Foreign Application Priority Data

Jul. 15, 2010 (DE) ..... 10 2010 027 412

(51) Int. Cl.
*A45F 3/00* (2006.01)
*A45F 3/08* (2006.01)
*A45F 3/12* (2006.01)

(52) U.S. Cl.
CPC ..... *A45F 3/08* (2013.01); *A45F 2003/125* (2013.01)

(58) Field of Classification Search
CPC ..... A45F 3/04; A45F 3/10; A45F 3/047; A45F 2003/122; A45F 3/08; A45F 2003/125
USPC ..... 224/633, 634, 635, 636, 262, 628, 637, 224/907, 630, 631, 263
See application file for complete search history.

(56) References Cited

U.S. PATENT DOCUMENTS

| | | | | |
|---|---|---|---|---|
| 46,886 | A * | 3/1865 | Dickey | 224/634 |
| 3,860,157 | A * | 1/1975 | Richards et al. | 224/153 |
| 3,889,859 | A * | 6/1975 | Joseph | 224/634 |
| 3,923,216 | A * | 12/1975 | Farnbach | 224/636 |
| 4,074,839 | A * | 2/1978 | Wood et al. | 224/635 |
| 4,356,942 | A * | 11/1982 | Hayes | 224/630 |
| 4,479,595 | A * | 10/1984 | Opsal | 224/630 |
| 4,982,884 | A * | 1/1991 | Wise | 224/634 |
| 5,016,289 | A * | 5/1991 | Greenberg | 2/246 |
| 5,292,043 | A * | 3/1994 | McHale | 224/634 |
| 5,361,955 | A * | 11/1994 | Gregory | 224/630 |
| 5,529,230 | A * | 6/1996 | Smith | 224/625 |
| 5,704,530 | A * | 1/1998 | Scherer | 224/632 |
| 5,725,139 | A * | 3/1998 | Smith | 224/637 |
| 5,730,347 | A * | 3/1998 | Finot | 224/631 |
| 5,762,243 | A * | 6/1998 | McMaster et al. | 224/262 |
| 5,823,414 | A * | 10/1998 | Gal et al. | 224/637 |
| 5,890,640 | A * | 4/1999 | Thompson | 224/630 |
| 5,954,253 | A * | 9/1999 | Swetish | 224/631 |

(Continued)

FOREIGN PATENT DOCUMENTS

| | | |
|---|---|---|
| DE | 19735806 | 2/1999 |
| FR | 2700677 A1 | 7/1994 |

(Continued)

*Primary Examiner* — Adam Waggenspack
*Assistant Examiner* — Matthew Theis
(74) *Attorney, Agent, or Firm* — Jura C. Zibas; Gregory N. Brescia; Wilson, Elser, Moskowitz, Edelman & Dicker, LLP.

(57) ABSTRACT

A backpack includes a bag having an interior packing space and a back wall that has a top and a bottom. The back wall includes an opening proximate the top of the back wall. A back contacting surface is attached to the top of the back wall and the bottom of the back wall. A frame is removably mounted to the back wall between the back wall and the back contacting surface. The frame includes a bend configured to space the back wall from the back contacting surface. The frame is insertable and removable to and from the back wall through the opening.

28 Claims, 2 Drawing Sheets

(56) References Cited

U.S. PATENT DOCUMENTS

| | | | | |
|---|---|---|---|---|
| 5,971,244 | A * | 10/1999 | Jaeger | 224/632 |
| 6,276,584 | B1 * | 8/2001 | McLachlan | 224/637 |
| 6,892,915 | B2 * | 5/2005 | Mares | 224/630 |
| 2004/0238303 | A1 * | 12/2004 | Hafif | 190/18 A |
| 2005/0035170 | A1 * | 2/2005 | Sears et al. | 224/630 |
| 2006/0191969 | A1 * | 8/2006 | Goulding et al. | 224/635 |
| 2007/0251965 | A1 * | 11/2007 | Mosley | 224/637 |

FOREIGN PATENT DOCUMENTS

| | | | |
|---|---|---|---|
| JP | H0723431 | | 5/1995 |
| JP | 3056999 | U | 3/1999 |
| JP | 2000093230 | A | 4/2000 |
| JP | 2005336975 | A | 12/2005 |

* cited by examiner

BACKPACK HAVING REMOVABLE FRAME

CROSS-REFERENCE TO RELATED APPLICATIONS

This application claims the benefit of German Utility Model No. DE 10 2010 027 412.7 filed Jul. 15, 2010 entitled "Backpack Having A Frame Arrangement Concavely Tensioning The Back Wall" which is hereby incorporated by reference herein in its entirety.

BACKGROUND OF THE INVENTION

The present invention generally relates to a backpack and, more particularly, to a backpack having a removable frame.

Various types of frame arrangements for backpacks are known. The purpose of some such frame arrangements is to tension a back contacting surface, such as a net material, while spacing a rear wall of the backpack from the user in order to enable an improved ventilation of the back area of the user. DE 197 35 806 B4 discloses, for example, a backpack having a frame arrangement substantially consisting of two approximately vertically and concavely running resilient frame parts, the upper and lower ends of which are in each case connected to each other by means of frame parts extending in the transverse direction. A net part is tensioned in a sinew-like manner in front of the frame.

BRIEF SUMMARY OF THE INVENTION

In one embodiment there is a backpack comprising (a) a packing space including a back wall facing a backpack wearer, (b) a net part coupled to the back wall, (c) a frame arrangement concavely tensioning the back wall, the net part extending between ends of the back wall, the frame arrangement being open at the bottom of the packing space and closed at the top of the packing space and which comprises two vertical frame parts and a frame region running in the transverse direction, ends of the frame region being connected to upper ends of the vertical frame parts, and (d) two lower pockets being spaced from each other in the transverse direction provided at the bottom of the packing space on a side of the back wall facing the net part, lower ends of the vertical frame parts configured to be inserted in said lower pockets, the vertical frame parts configured to be guided through an opening of the back wall from the inside of the packing space in such a way that the lower ends of the vertical frame parts engage with the lower pockets and the frame region running in the transverse direction can be inserted in an upper pocket on the back wall.

In one embodiment, a middle portion of the vertical frame parts are each detachably fixed to the back wall by a fixture device. In one embodiment, the fixture device comprises a reinforcement member which is attached to the back wall and at least one retaining tab, said retaining tab being passed around one of the a vertical frame parts and detachably fixed to the reinforcement member. In one embodiment, the retaining tab is attachable to the reinforcement member by a hook-and-loop fastener. In one embodiment, the opening can be closed by a closing device. In one embodiment, the closing device includes a zipper. In one embodiment, the frame arrangement is shaped in such a way that the vertical frame parts each extend from the frame region to a predetermined place in the direction of the back wall in an arch-shaped manner in order to concavely tension the back wall, and each vertical frame part extends from said predetermined place to the lower ends of the vertical frame parts in the direction of the net part in an arch-shaped manner in order to achieve a transmission of load to the pelvic region of a backpack wearer.

In one embodiment, the predetermined place is located below the middle portion. In one embodiment, the opening extends in the transverse direction of the back wall. In one embodiment, the upper pocket is formed by a region of the net part and a region of the back wall attached to the net part. In one embodiment, the upper pocket is above the opening. In one embodiment, the lower end regions of the vertical frame parts are each bent 180° in such a way that lower rounded ends are formed. In one embodiment, a lower end of the net part is attached to a lower side of the back wall. In one embodiment, the lower pockets are formed by regions of the net part and regions of the back wall attached to the net part. In one embodiment, the frame arrangement is shaped in such a way that the vertical frame parts converge from the frame region running to the bottom towards a middle portion, and diverge from each other from the middle portion running to the bottom towards the lower ends of the vertical frame parts.

In one embodiment there is a backpack comprising (a) a packing space including a back wall facing a backpack wearer, (b) a net part coupled to the back wall, (c) a frame arrangement concavely tensioning the back wall, the net part extending between ends of the back wall, the frame arrangement being open at the bottom of the packing space and closed at the top of the packing space and which comprises two approximately vertically running frame parts and a frame region running in the transverse direction, ends of the frame region being connected to upper ends of the vertically running frame parts, and (d) two lower pockets being spaced from each other in the transverse direction are provided at the bottom of the packing space on the side of the back wall facing the net part, lower ends of the vertical frame parts configured to be inserted in said pockets, the frame parts configured to be guided through an opening of the back wall from the inside of the packing space in such a way that the lower ends of the vertical frame regions engage with the lower pockets and the frame region running in the transverse direction can be inserted in an upper pocket being formed on the back wall.

In one embodiment, a middle portion of the vertical frame parts are each detachably fixed to the back wall by means of a fixture device. In one embodiment, the fixture device comprises a reinforcement member which is attached to the back wall and wherein at least one retaining tab is arranged in each case, said retaining tab being passed around a vertical frame region and detachably fixed to the reinforcement member. In one embodiment, the retaining tab is attachable to the reinforcement member by means of a hook-and-loop fastener. In one embodiment, the opening can be closed by means of a closing device. In one embodiment, the closing device includes a zipper. In one embodiment, the frame arrangement is shaped in such a way that the vertical frame parts each extend from the upper frame region to a predetermined place in the direction of the back wall in an arch-shaped manner in order to concavely tension the back wall, and each vertical frame part extends from said place to the ends of the vertical frame regions in the direction of the net part in an arch-shaped manner in order to achieve a particularly effective transmission of load to the pelvic region of a backpack wearer.

In one embodiment, the place is located below the middle portion. In one embodiment, the opening extends in the transverse direction of the back wall. In one embodiment, the upper pocket is formed by a region of the net part and a region of the back wall attached to the net part. In one embodiment, the upper pocket is above the opening. In one embodiment, the lower end regions of the vertical frame parts are each bent 180° in such a way that lower rounded ends are formed. In one embodiment, the lower end of the net part is attached to the lower side of the back wall. In one embodiment, the lower pockets are formed by regions of the net part and regions of the back wall attached to the net part. In one embodiment, the frame arrangement is shaped in such a way that the vertical frame parts converge from the upper frame region running to the bottom towards a middle portion, and move away from each other from the middle portion running to the bottom towards the ends of the vertical frame parts.

In another embodiment there is a backpack comprising (a) a bag including an interior packing space and a back wall having a top and a bottom, the back wall including an opening proximate the top of the back wall, (b) a back contacting surface attached to the top of the back wall and the bottom of the back wall, and (c) a frame removably mounted to the back wall between the back wall and the back contacting surface, the frame including a bend configured to space the back wall from the back contacting surface, the frame insertable and removable to and from the back wall through the opening. In one embodiment, the frame includes a first leg, a second leg and a transverse member connecting the first leg to the second leg, the first leg having a first free end and the second leg having a second free end.

In a further embodiment, the backpack comprises a fixture device attached to the back wall and configured to releasably retain the frame between the transverse member and the first and second free ends. In one embodiment, the fixture device includes a first retaining tab configured to couple to the first leg and a second retaining tab configured to couple to the second leg. In one embodiment, the fixture device includes a reinforcement member, the first and second retaining tabs being attachable to the reinforcement member by a hook-and-loop fastener. In one embodiment, the first leg and second leg each include a bend such that the bends are spaced apart from one another a distance less than a length of the transverse member. In one embodiment, the first leg and second leg each include a bend such that the bends lie on a plane that is spaced from a plane including the free end of the first leg, the free end of the second leg and the transverse member.

In one embodiment, the back wall includes a first pocket configured to releasably retain the transverse member, a second pocket configured to releasably retain the free end of the first leg and a third pocket configured to releasably retain the free end of the second leg. In one embodiment, the free end of the first leg is bent 180 degrees and the free end of the second leg is bent 180 degrees. In one embodiment, the back wall has a generally convex upper portion and a generally concave lower portion. In one embodiment, the back contacting surface includes a mesh material. In one embodiment, includes at least one pocket for retaining the frame. In one embodiment, the opening includes a zipper.

BRIEF DESCRIPTION OF THE SEVERAL VIEWS OF THE DRAWINGS

The foregoing summary, as well as the following detailed description of embodiments of the backpack frame, will be better understood when read in conjunction with the appended drawings of an exemplary embodiment. It should be understood, however, that the invention is not limited to the precise arrangements and instrumentalities shown.

In the drawings.

DETAILED DESCRIPTION OF THE INVENTION

Figure 1:
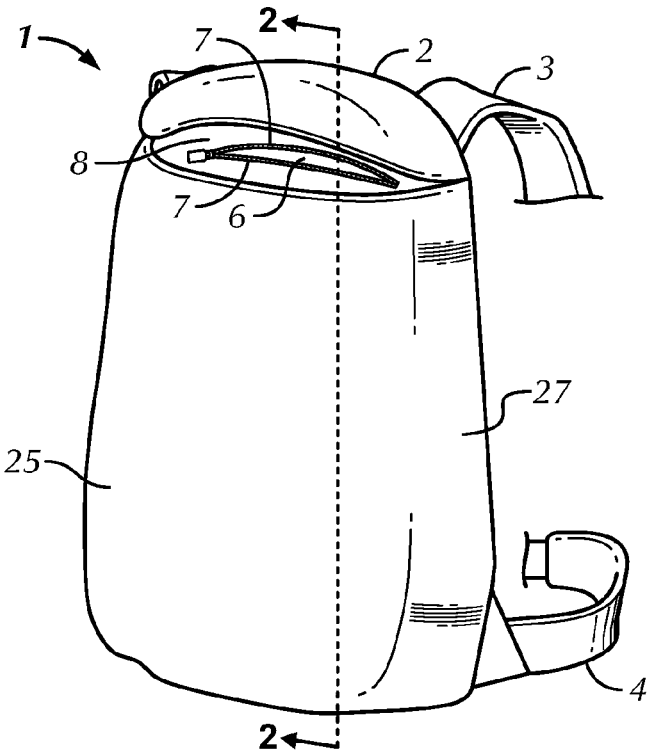
FIG. 1 is a front perspective view of a backpack in accordance with an exemplary embodiment of the present invention with the cover part open such that the upper end of the back wall and the opening for inserting the frame of the backpack are visible.

Referring to the drawings in detail, wherein like reference numerals indicate like elements throughout, there is shown in FIGS. 1-5 a backpack and frame, generally designated 1 and 9 respectively, in accordance with an exemplary embodiment of the present invention.

According to the present invention, it may be desirable to have frame 9 be quickly and easily removably mounted to backpack 1. For example, a user may wish to remove frame 9 in order to place backpack 1 into a washing machine. Following washing, the user may securely remount frame 9 to backpack 1. In another example, the user may wish to replace frame 9 if frame 9 were to become damaged. After the damaged frame 9 has been removed from backpack 1, a replacement frame 9 may be installed. In yet another example, the user may wish to replace a first frame 9 with a second frame 9. The second frame 9 may provide for a different shape of a packing space 5 of the backpack 1 and/or a different tension of back contacting surface 17.

Figure 2:
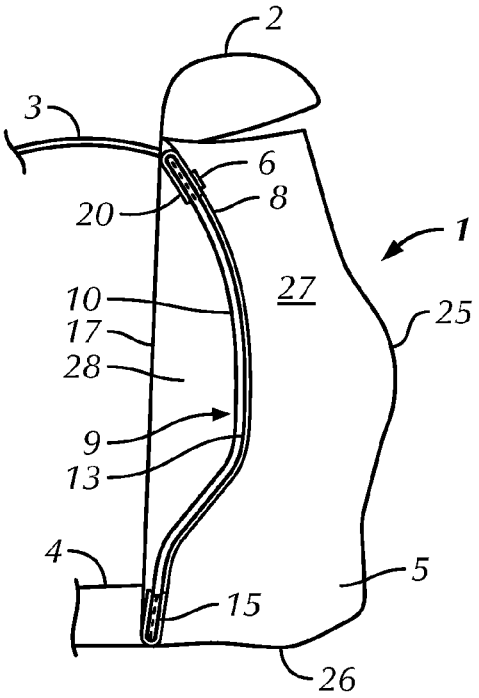
FIG. 2 is a cross sectional view of the backpack of FIG. 1 taken along the line 2-2.

Referring to FIGS. 1 and 2, in some embodiments, backpack 1 includes a bag that forms an interior packing space 5. In one embodiment, interior packing space 5 is formed between a front wall 25, a back wall 8, a bottom wall 26, and side walls 27. Backpack 1 may include one or more openings for accessing packing space 5. In some embodiments, backpack 1 includes a cover part 2 for covering packing space 5. Cover part 2 may be secured to front and side walls 25, 27 using a fastener such as a zipper. In other embodiments, rather than or in addition to cover part 2, backpack 1 includes one or more zippered, or otherwise closeable, openings for accessing packing space 5 and/or additional packing spaces. Backpack 1 includes one or more shoulder belts 3 for carrying items on the user's shoulders. In one embodiment, backpack 1 includes a shoulder belt 3 for each shoulder. In some embodiments, backpack 1 includes a pelvic belt 4. In some embodiments, backpack 1 includes a chest belt. In some embodiments, backpack 1 is configured to be used for hiking Backpack 1 may have any configuration known in the art, including any belts, straps and pockets, for carrying items on the back of a person.

In one embodiment, backpack 1 includes an opening 6 on back wall 8. In one embodiment, opening 6 is accessible from packing space 5. In an alternative embodiment, opening 6 is accessible directly such as through the top of backpack 1. In one embodiment, opening 6 is configured to be fastened closed. In one embodiment, opening 6 includes a fastener 7. In one embodiment, fastener 7 includes a zipper.

Referring to FIG. 2, backpack 1 includes a removably attached frame 9. In one embodiment, frame 9 concavely tensions back wall 8. In one embodiment, back wall 8 facing packing space 5 has a generally convex upper portion and a generally concave lower portion as described further below. In one embodiment, a back contacting surface 17 extends in a sinew-like manner from back wall 8. In one embodiment, frame 9 is positioned between back wall 8 and back contacting surface 17. In one embodiment, back contacting surface 17 is attached to back wall 8 at the top and bottom of back wall 8. In some embodiment, back contacting surface 17 is sewn to back wall 8. In some embodiments, back contacting surface 17 is completely open on each lateral side of the backpack 1. In other embodiments, back contacting surface 17 is at least partially attached to side walls 27.

In one embodiment, back contacting surface 17 includes a net part. In one embodiment, back contacting surface 17 is comprised of a breathable or vented material. In one embodiment, back contacting surface 17 is comprised of a mesh material. In one embodiment, back contacting surface 17 is resilient. In one embodiment, back contacting surface 17 is configured to conform to the shape and movement of a backpack wearer's back without significantly effecting back wall 8. In some embodiments, back contacting surface 17 includes one or more pads configured to contact the backpack wearer's back.

In some embodiments, spacing back contacting surface 17 from back wall 8 forms a ventilation space 28 between back contacting surface 17 lying flat against the back of a backpack wearer when backpack 1 is worn, and the back wall 8. Ventilation space 28 may avoid direct contact between back wall 8 and the back of the backpack wearer, thereby enabling the ventilation of the backpack wearer's back and/or remove or distribute pressure on the backpack wearer's back from items within packing space 5. In one embodiment, air flow is vented into ventilation space 28 between back wall 8 and back contacting surface 17 from one sidewall 27 to the other sidewall 27. In some embodiments, ventilation space 28 also allows for increased comfort by spacing back wall 8

Figure 3:
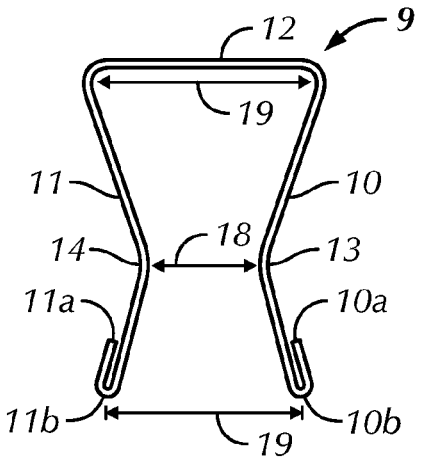
FIG. 3 is a front view of a frame in accordance with an exemplary embodiment of the present invention.
Figure 4:
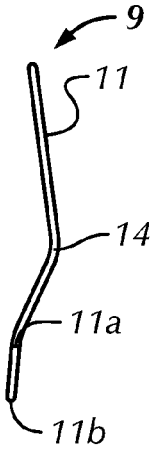
FIG. 4 is a side elevational view of the frame of FIG. 3.

Referring to FIGS. 2-4, in one embodiment, a frame arrangement or frame 9 is provided, which is open or unconnected at the bottom and closed or connected at the top. In one embodiment, frame 9 includes a first frame region 10 and a second frame region 11 vertically running from a third frame region 12 running generally in the transverse direction and connecting first frame region 10 and second frame region 11. In one embodiment, a distal or lower ends 10*a*, 11*a* of the first and second frame regions 10, 11 are bent upwardly in such a way that they run approximately parallel to the remainder of first and second frame regions 10, 11. As a result, in some embodiments, lower arch-shaped and/or rounded ends 10*b*, 11*b* are formed. In one embodiment, the lower ends 10*a*, 11*a* of first and second frame regions 10, 11 are each bent through preferably 180° in such a way that a lower rounded end 10*b*, 11*b* is formed. In some embodiments, bending lower ends 10*a*, 11*a* reduces wear on lower pockets 15, 16 as described further below. In other embodiments, lower ends 10*a*, 11*a* include an enlarged area or cap to reduce wear on lower pockets 15, 16.

Frame 9 may be shaped in any manner to provide the desired ventilation space 28 between back contacting surface 17 and back wall 8 and/or the desired shape of packing space 5. Referring to FIG. 3, in one embodiment, first and second frame regions 10, 11 extend from opposite ends of third frame region 12 obliquely inwardly towards each other in such a way that a distance 18 between first and second frame regions 10, 11 is smallest proximate first and second bending regions 13, 14 of first and second frame regions 10, 11. In one embodiment, first and second frame regions 10, 11 extend obliquely outwardly from first and second bending regions 13, 14. In one embodiment, lower end regions 10*a*, 11*a* are spaced apart a distance generally equal to a distance 19 between the upper end regions of the first and second frame regions 10, 11 proximate third frame region 12. In one embodiment, first and second bending regions 13, 14 are proximate a vertical mid-point of frame 9. In one embodiment, first and second bending regions 13, 14 are closer to lower ends 10*a*, 11*a* than they are from third frame region 12.

Referring to FIG. 4, in one embodiment, first and second frame regions 10, 11 each extend from back contacting surface 17 in a bent or arch-shaped manner. In one embodiment, first and second frame regions form an apex away from back contacting surface 17 proximate first and second bending regions 13, 14. In one embodiment, first and second frame regions 10, 11 extend substantially straight above first and second bending regions 13, 14. In one embodiment, the substantially straight upper portion of first and second frame regions 10, 11 bend under the tension of back contacting surface 17. In one embodiment, portions of first and second frame regions 10, 11 are bent back inwardly toward back contacting surface 17 below first and second bending regions 13, 14. In one embodiment, bending first and second frame regions 10, 11 back toward back contacting surface 17 below first and second bending regions 13, 14. In one embodiment, frame 9 is generally convex shaped above bending regions 13, 14 and generally concave below bending regions 13, 14. In some embodiments, the shape of frame 9 allows for a favourable transmission of load from the packing space 5 to pelvic belt 4 when backpack 1 is in use.

In one embodiment, frame 9 is resilient. In one embodiment, frame 9 is most resilient towards the bottom of frame 9 since lower ends 10*b*, 11*b* are not directly connected to one another. In one embodiment, frame 9 is bent after being attached to back wall 8 (compare FIG. 4 to FIG. 2) such that one or more of back contacting surface 17 and back wall 8 are held under tension by frame 9 during use. In one embodiment frame 9 is comprised of a single continuous component. In other embodiments, frame 9 is comprised of two or more removably attached components such that frame 9 may be stored in a collapsed configuration when removed from back wall 8. In one embodiment, frame 9 is comprised of a metallic wire. In one embodiment, frame 9 is comprised of a polymeric material. In one embodiment, frame 9 is comprised of a metallic material coated with a polymeric material. In one embodiment, frame 9 is hollow. In one embodiment, frame 9 is solid.

Figure 5:
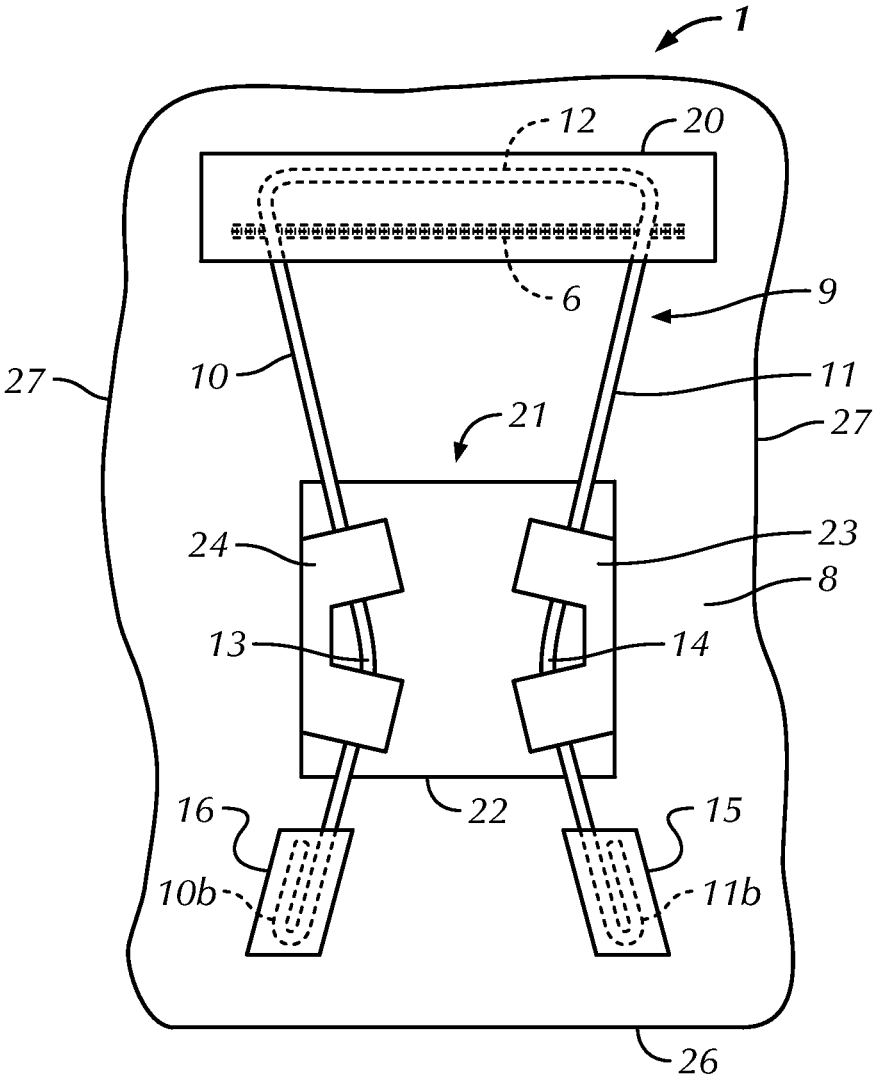
FIG. 5 is rear perspective view of the backpack of FIG. 1 with the back contacting surface removed to show the frame of FIG. 2.

Frame 9 may be removably attached to back wall 8 between back wall 8 and back contacting surface 17. Referring to FIGS. 2 and 5, in one embodiment, in use, lower ends 10*b*, 11*ba* of frame 9 are inserted through opening 6 of the back wall 8. In one embodiment, during installation, frame 9 is inserted into opening 6 and moved downwards along the outside of back wall 8 until lower ends 10*b*, 11*b* engage with lower pockets 15, 16. In one embodiment, lower pockets 15, 16 are separate and spaced apart on back wall 8. In one embodiment, the center of lower pockets 15, 16 are spaced apart less than distance 19 such that first and second frame regions 10, 11 are keep under tension. In one embodiment, the center of lower pockets 15, 16 are spaced apart greater than distance 19 such that first and second frame regions 10, 11 are keep under tension. In one embodiment, lower pockets 15, 16 are sewn onto back wall 8. In one embodiment, lower pockets 15, 16 are formed between back contacting surface 17 and back wall 8. In one embodiment, one or more edges, such as the lower edges, of lower pockets 15, 16 are formed by the connection between back contacting surface 17 and back wall 8.

In one embodiment, opening 6 of the back wall 8 running in the transverse direction is spaced from the upper edge of the back wall 8 in such a way that an upper pocket 20 for receiving third frame region 12 of the frame 9 exists above the opening 6 in the upper end region of the back wall 8. In one embodiment, upper pocket 20 is formed between back contacting surface 17 and back wall 8. In one embodiment, one or more edges, such as the upper edge, of upper pocket 20 is formed by the connection between back contacting surface 17 and back wall 8.

In addition to upper and lower pockets 20, 15, 16, frame 9 may be further secured to back wall 8. Referring to FIG. 5, in one embodiment, a fixture device 21 is attached to back wall 8 proximate bending regions 13, 14. In one embodiment, fixture device 21 helps to fix first and second frame regions 10, 11 proximate back wall 8. In one embodiment, fixture device 21 includes a generally flat reinforcement region 22. In one embodiment, reinforcement region 22 is comprised of a generally rigid material such as plastic. In other embodiments, reinforcement region 22 is comprised of a generally flexible material similar to the material of back wall 8. In one embodiment, fixture device 21 is sewn to the outside of back wall 8. In other embodiments, fixture device 21 is attached to an inside surface of back wall 8.

In one embodiment, fixture device includes two or more retaining tabs 23, 24 for attaching to first and second frame regions 10, 11. In one embodiment, retaining tabs 23, 24 extend over a portion of first and second frame regions 10, 11 proximate bending regions 13, 14. In one embodiment, retaining tabs 23, 24 are fixedly attached to reinforcement region 22 and have a releaseably securable edge. In one embodiment, retaining tabs 23, 24 are fixedly attached to reinforcement region 22 between first and second frame regions 10, 11. In another embodiment, retaining tabs 23, 24 are fixedly attached to reinforcement region 22 outside of first and second frame regions 10, 11. In yet another embodiment, retaining tabs 23, 24 are not fixedly attached to reinforcement region 22 and are only releasably secured to reinforcement region 22. In one embodiment, retaining tabs 23, 24 are attachable to the reinforcement member 22 by means of hook-and-loop fasteners.

Due to the configuration of backpack 1 and frame 9, it may be particularly easy to attach frame 9 to the outside of the back wall 8. In one embodiment, after opening fastener 7, which closes opening 6, frame 9 is inserted into opening 6 and moved downwards to the space between the outside of the back wall 8 and the inside of back contacting surface 17 until lower ends 10*b*, 11*b* of first and second frame regions 10, 11 engage with lower pockets 15, 16. In one embodiment, by bending frame 9, third frame region 12 extending in the transverse direction may then be inserted in upper pocket 20 formed above the opening 6. In one embodiment, first and second frame regions 10, 11 are resiliently tensioned so that back wall 8 is concavely tensioned in front of back contacting surface 17 and ventilation space 28 between the back wall 8 and back contacting surface 17 is formed. In some embodiment, bending regions 13, 14 are then attached to reinforcement region 22 by retaining tabs 23, 24.

In one embodiment, the present invention provides a backpack having a packing space, a back wall facing a backpack wearer as well as a frame arrangement concavely tensioning the back wall and a net part extending in a sinew-like manner over the concavely tensioned back wall. The frame arrangement has the shape of a frame which is open at the bottom of the packing space and closed at the top of the packing space and which comprises two approximately vertically running frame regions as well as a frame region running in the transverse direction, the ends of which are connected to the upper ends of the vertical frame parts. On the back wall, two lower pockets are spaced from each other in the transverse direction are provided at the bottom of the packing space on the side facing the net part, wherein the lower ends of the vertical frame regions can be inserted in said pockets. The frame can be guided through an opening of the back wall from the inside of the packing space in such a way that the lower ends of the vertical frame regions engage with the lower pockets and the frame region running in the transverse direction can be inserted in an upper pocket being formed on the side of the back wall facing the net part.

In one embodiment, the backpack according to the invention essentially consists of a one-piece frame, which is closed in its upper region and open in its lower region, wherein the lower end regions being spaced from each other in the transverse direction can easily be arranged in pockets disposed on the outside and/or on the side of the back wall of the backpack facing the net part, because the frame is be movable from top to bottom with said end regions ahead from the packing space of the backpack through an upper transversely extending opening on the side on the back wall facing the net part until said end regions are inserted in said lower pockets.

In one embodiment, the frame arrangement disposed on the back wall of the backpack is shaped in such a way that for the carrying of higher loads, flexibility is increased while stiffness is maintained. Increased flexibility results from the fact that the frame arrangement is open at the bottom. Due to the specific structure of the frame arrangement, it has to be ensured that the load applied by the backpack to the back of the backpack wearer is distributed forwardly towards the pelvis of the backpack wearer.

It will be appreciated by those skilled in the art that changes could be made to the exemplary embodiments shown and described above without departing from the broad inventive concept thereof. It is understood, therefore, that this invention is not limited to the exemplary embodiments shown and described, but it is intended to cover modifications within the spirit and scope of the present invention as defined by the claims. For example, specific features of the exemplary embodiments may or may not be part of the claimed invention and features of the disclosed embodiments may be combined. The words "top", "bottom", "downward", "upward", "right", "left", "lower", "upper", "inwardly", "outwardly" and similar words refer to directions toward and away from, respectively, the geometric center of the backpack, frame or other referenced feature. Unless specifically set forth herein, the terms "a", "an" and "the" are not limited to one element but instead should be read as meaning "at least one".

It is to be understood that at least some of the figures and descriptions of the invention have been simplified to focus on elements that are relevant for a clear understanding of the invention, while eliminating, for purposes of clarity, other elements that those of ordinary skill in the art will appreciate may also comprise a portion of the invention. However, because such elements are well known in the art, and because they do not necessarily facilitate a better understanding of the invention, a description of such elements is not provided herein.

REFERENCE NUMERALS

1 backpack
2 cover part
3 shoulder belt
4 pelvic belt
5 packing space
6 opening
7 fastener
8 back wall
9 frame

10 first frame region
11 second frame region
12 third frame region
13 first bending region
14 second bending region
15 first lower pocket
16 second lower pocket
17 back contacting surface
18 distance
19 distance
20 upper pocket
21 fixture device
22 reinforcement region
23 first retaining tab
24 second retaining tab
25 front wall
26 bottom wall
27 side walls
28 ventilation space

I claim:

1. A backpack comprising:

a packing space including a back wall facing a backpack wearer;

a net part coupled to the back wall;

a frame arrangement concavely tensioning the back wall, the net part extending between ends of the back wall, the frame arrangement being open at a bottom of the packing space and closed at a top of the packing space and comprising two vertical frame parts and a frame region running in the transverse direction, ends of the frame region being connected to upper ends of the vertical frame parts, the vertical frame parts diverging from one another from a middle portion towards lower free ends of the vertical frame parts, the lower free ends of the vertical frame parts pointing toward the net part, the frame arrangement configured to transmit a load in the packing space to a back of the backpack wearer proximate the bottom of the packing space; and two lower pockets being spaced from each other in the transverse direction provided at the bottom of the packing space on a side of the back wall facing the net part, the lower free ends of the vertical frame parts configured to be inserted in said lower pockets, the vertical frame parts configured to be guided through an opening of the back wall from the inside of the packing space in such a way that the lower free ends of the vertical frame parts engage with the lower pockets and the frame region running in the transverse direction can be inserted in an upper pocket on the back wall;

wherein the middle portion of the vertical frame parts are each detachably fixed to the back wall by a fixture device, and wherein the fixture device comprises a reinforcement member which is attached to the back wall and at least one retaining tab, said retaining tab being passed around one of the vertical frame parts and detachably fixed to the reinforcement member.

2. The backpack according to claim 1, wherein the retaining tab is attachable to the reinforcement member by a hook-and-loop fastener.

3. The backpack according to claim 1, wherein the opening can be closed by a closing device.

4. The backpack according to claim 3, wherein the closing device includes a zipper.

5. The backpack according to claim 1, wherein the frame arrangement is shaped in such a way that the vertical frame parts each extend from the frame region to a predetermined place in the direction of the back wall in an arch-shaped manner in order to concavely tension the back wall, and each vertical frame part extends from said predetermined place to the lower free ends of the vertical frame parts in the direction of the net part in an arch-shaped manner in order to achieve a transmission of load to a pelvic region of a backpack wearer.

6. The backpack according to claim 5, wherein the predetermined place is located below a middle portion of the vertical frame parts.

7. The backpack according to claim 1, wherein the opening extends in the transverse direction of the back wall.

8. The backpack according to claim 1, wherein the upper pocket is formed by a region of the net part and a region of the back wall attached to the net part.

9. The backpack according to claim 1, wherein the upper pocket is above the opening.

10. The backpack according to claim 1, wherein the lower free ends of the vertical frame parts are each bent 180° in such a way that lower rounded ends are formed.

11. The backpack according to claim 1, wherein a lower end of the net part is attached to a lower side of the back wall.

12. The backpack according to claim 1, wherein the lower pockets are formed by regions of the net part and regions of the back wall attached to the net part.

13. The backpack according to claim 1, wherein the vertical frame parts coverage from the frame region running to the bottom towards a middle portion.

14. A backpack comprising:

a bag including an interior packing space and a back wall having a top and a bottom, the back wall including an opening proximate the top of the back wall;

a back contacting surface attached to the top of the back wall and the bottom of the back wall; and a frame removably mounted to the back wall between the back wall and the back contacting surface, the frame configured to space the back wall from the back contacting surface, the frame insertable and removable to and from the back wall through the opening, the frame including a first leg, a second leg and a transverse member connecting the first leg to the second leg, the first leg having a first free end and the second leg having second free end, the first and second legs diverging from one another from a middle portion towards the first and second free ends, the first and second legs pointing toward the back contacting surface;

a fixture device attached to the back wall and configured to releasably retain the frame between the transverse member and the first and second free ends, wherein the fixture device includes a first retaining tab configured to couple to the first leg and a second retaining tab configured to couple to the second leg, wherein the fixture device includes a reinforcement member, the first and second retaining tabs being attachable to the reinforcement member.

15. The backpack of claim 14, wherein the first free end is spaced apart from the second free end a distance generally equal to a length of the transverse member.

16. The backpack of claim 14, wherein the first leg and second leg each include a bend such that the bends lie on a plane that is spaced from a plane including the first free end, the second free end and the transverse member.

17. The backpack of claim 14, wherein the back wall includes a first pocket configured to releasably retain the transverse member, a second pocket configured to releasably retain the first free end and a third pocket configured to releasably retain the second free end.

18. The backpack of claim 14, wherein the first free end is bent 180 degrees and the second free end is bent 180 degrees.

19. The backpack of claim 14, wherein the back wall, when the frame is mounted to the back wall, has a generally convex upper portion and a generally concave lower portion.

20. The backpack of claim 14, wherein the back contacting surface includes a mesh material.

21. The backpack of claim 14, wherein back wall includes at least one pocket for retaining the frame.

22. The backpack of claim 14, wherein the opening includes a zipper.

23. The backpack of claim 14, wherein an entire side of the frame is in contact with the back wall.

24. The backpack of claim 14, wherein the frame only contacts the back contacting portion proximate the top and bottom of the back wall.

25. The backpack of claim 1, wherein the lower free ends are spaced apart from one another a distance generally equal to a length of a top transverse member.

26. The backpack of claim 25, wherein the two lower pockets are spaced apart from one another a distance unequal to the distance between the lower free ends under no load such that the vertical frame parts are kept under tension when the lower free ends are inserted into the two lower pockets.

27. The backpack of claim 17, wherein the first fee end is spaced apart from the second free end a distance generally equal to a length of the transverse member under no load, and the second pocket is spaced apart from the third pocket a distance unequal to the distance between the first free end and the second free end under no load such that first leg and the second leg are kept under tension when the first free end is inserted in the second pocket and the second free end is inserted in the third pocket.

28. The backpack of claim 14, wherein the frame is configured to transmit a load in the interior packing space to a back of a backpack wearer proximate the bottom of the back wall.

* * * * *